US011798761B2

(12) United States Patent
Mccord et al.

(10) Patent No.: US 11,798,761 B2
(45) Date of Patent: Oct. 24, 2023

(54) SYSTEM FOR CONTROLLING AND COOLING GAS OF CIRCUIT BREAKER AND METHOD THEREOF

(71) Applicant: TECHNOLOGIES MINDCORE INC., Terrebonne (CA)

(72) Inventors: Neil Mccord, Terrebonne (CA); Julien Rioux, Terrebonne (CA); Louis-Philippe Gauvreau, Terrebonne (CA); Renaud Grenier-Poulin, Terrebonne (CA); Eric Renaud, Terrebonne (CA); Jonathan Begin, Terrebonne (CA); Jocelyn Ouellet, Terrebonne (CA); Philippe Corriveau, Terrebonne (CA)

(73) Assignee: TECHNOLOGIES MINDCORE INC., Terrebonne (CA)

( * ) Notice: Subject to any disclaimer, the term of this patent is extended or adjusted under 35 U.S.C. 154(b) by 16 days.

(21) Appl. No.: 17/456,112

(22) Filed: Nov. 22, 2021

(65) Prior Publication Data

US 2022/0165523 A1 May 26, 2022

Related U.S. Application Data

(60) Provisional application No. 63/116,642, filed on Nov. 20, 2020.

(51) Int. Cl.
*H01H 33/53* (2006.01)
*H01H 33/90* (2006.01)

(52) U.S. Cl.
CPC ..... *H01H 33/53* (2013.01); *H01H 33/90* (2013.01)

(58) Field of Classification Search
CPC .... H01H 33/53; H01H 33/90; H01H 33/7015; H01H 33/7023; H01H 33/7038; H01H 33/7076; H01H 9/52; H01H 2009/526
USPC ..... 218/49, 53, 57, 59, 61, 68
See application file for complete search history.

(56) References Cited

U.S. PATENT DOCUMENTS 6,472,628 B2 * 10/2002 Nauche ..... H01H 33/901 218/43
8,389,886 B2 * 3/2013 Dahlquist ..... H01H 33/74 218/59
8,633,413 B2 * 1/2014 Cernat ..... H01H 33/901 218/59
9,076,611 B2 * 7/2015 Cernat ..... H01H 33/7015
9,496,107 B2 * 11/2016 Kim ..... H01H 33/90
2005/0150868 A1 * 7/2005 Nowakowski ..... H01H 33/7015 218/57

(Continued)

*Primary Examiner* — William A Bolton
(74) *Attorney, Agent, or Firm* — Brouillette Legal Inc.; Robert Brouillette

(57) ABSTRACT

A fluid flow and cooling system and method are provided. The system has a substantially cylindrical tube shape and is configured to be installed in a circuit breaker for allowing the flow of fluids while dissipating heat from said fluids. The system comprises a plurality of openings on each of front and back surfaces, the openings of the front surface being connected to the openings of the back surface by a plurality of side passages. By having a plurality of side passages for the flow of fluids, heat dissipation may be improved compared to previous circuit breakers tubes for dispensing arc quenching fluid. The method cools a fluid flowing in a cooling device having side passages.

25 Claims, 6 Drawing Sheets

(56) References Cited

U.S. PATENT DOCUMENTS

2009/0107957 A1* 4/2009 Drews ..... H01H 33/74
218/53
2018/0342363 A1* 11/2018 Ozil ..... H01H 33/703

* cited by examiner

SYSTEM FOR CONTROLLING AND COOLING GAS OF CIRCUIT BREAKER AND METHOD THEREOF

CROSS-REFERENCE TO RELATED APPLICATIONS

The present patent application claims the benefits of priority of commonly assigned American Provisional Patent Application No. 63/116,642, entitled "SYSTEM FOR CONTROLLING AND COOLING GAS OF CIRCUIT BREAKER AND METHOD THEREOF" and filed at the United States Patent and Trademark Office on Nov. 20, 2020, the content of which is incorporated herein by reference.

FIELD OF THE INVENTION

The present invention generally relates the field of gas circuit breakers and methods of cooling gas. More specifically, the present invention relates to systems and methods for improving gas flow and cooling within a gas circuit breaker.

BACKGROUND OF THE INVENTION

Circuit switchers typically use circuit breakers for switching a circuit on and off when the current flowing through a system supersedes its design limitations. Circuit breakers of medium to high voltages applications often use gas as a means to cool and absorb electrical arcs produced by the circuit breaker when opened.

Broadly, a gas circuit breaker comprises gas within an inner cavity. When the current reaches a level over a predetermined current level, the gas within the inner cavity is heated, which in turns increases the pressure of the gas. An external control module may force a moving portion of the circuit breaker to be displaced. As the said portion is moved, the circuit breaker is disengaged.

Whether it be air insulated systems or gas insulated systems, both using gas for the quenching, the cooling of the SF6 gas or any other similar gas used is essential for dissipating heat in the system. Generally, once gas has been heated up by electrical arcs located in the opened zone of an opened circuit breaker, said gas must be exhausted out of said opening zone for cooling as it will be replaced by cooler gas. Gas must also be cooled when circulating from a compressed gas chamber of a puffer chamber before entering in the opened zone of an opened circuit breaker. In order to save space and time for cooling gas, there is a need for a system improving the cooling of gas when flowing into or out of an arc quenching zone.

SUMMARY OF THE INVENTION

The aforesaid and other objectives of the present invention are realized by generally providing a system for controlling and cooling gas of a circuit breaker. In a first aspect of the invention, the system provided comprises a substantially cylindrical tube shape and is configured to be installed in a circuit breaker for allowing the flow of fluids while dissipating heat from said fluids.

In another aspect of the invention, the system comprises a plurality of openings on each of front and back surfaces, the openings of the front surface being connected to the openings of the back surface by a plurality of passages. By having a plurality of passages for the flow of fluids, heat dissipation may be improved compared to previous circuit breakers tubes for dispensing arc quenching fluid.

A method for controlling and cooling gas of a circuit breaker is further provided.

In one aspect of the present invention, a fluid cooling device for a circuit breaker is provided. The device has an annular main body comprising a front surface, a back surface, an outer portion comprising outer and inner surfaces, a central passage connecting an aperture of the front surface to an aperture of the back surface, the central passage being adapted to receive a rod of the circuit breaker and a plurality of side passages through the outer portion connecting the front surface to the back surface, the plurality of side passages comprising an inner passage surface allowing flow of the fluid through the outer portion of the annular main body, the plurality of side passages having a heat transfer rate being higher than a heat transfer rate of the central passage.

The front surface may comprise a plurality of front openings, each of the plurality of front openings being fluidly connected to one of the plurality of the side passages and the back surface comprising a plurality of back openings, each of the plurality of back openings being fluidly connected to one of the plurality of the side passages. Each of the plurality of the front openings may be associated with one of the plurality of back openings. Each of the plurality of side passages may be fluidly connected to more than one of the plurality of front openings. Each of the plurality of side passages may be fluidly connected to more than one of the plurality of back openings.

The device may comprise a connecting member extending from the back surface for connecting the device to the circuit breaker. The connecting member may be a protuberance. The connecting member may have a periphery larger than a periphery of the central passage. The connecting member may be an annular portion extending from the outer portion of the device. A peripheral section of the connecting member comprising notches may be adapted to mate with a portion of the circuit breaker.

The outer surface may comprise notches adapted to mate with the circuit breaker. The outer surface may comprise sleeves to mate with the circuit breaker.

The main body may have a circular annular shape. The main body may be shaped as a generally cylindrical tube. The main body may have a non-circular annular shape. The fluid may be gas.

The plurality of side passages may have a rectangular shape. Some sectional area of a first of the side passages may have a different shape than the sectional area of a second of the side passages. The plurality of side passages and of front and back openings may have a rectangular shape.

In yet another aspect of the invention, a circuit breaker system is provided. The system comprise a device having an annular main body comprising a front surface, a back surface, an outer portion comprising outer and inner surfaces, a central passage passing through the front surface and the back surfaces and a plurality of side passages through the outer portion connecting the front surface to the back surface, the plurality of side passages comprising an inner passage surface allowing flow of the fluid through the outer portion of the annular main body, the plurality of side passages having a superior heat transfer rate than a heat transfer rate of the central passage. The system further comprises a first rod fitting inside the central passage and being adapted to be secured to a contact, a second rod adapted to contact with the contact and to move away from the contact, a fluid chamber in fluid connection with the plurality of side passages from the front surface of the device and an arc quenching zone between the contact and the second rod, the arc quenching zone being in fluid connection with the plurality of side passages from the back surface of the device, wherein the displacement of the contact toward and away from the second rod creates flow of the fluid in the side passages of the device.

The system may further comprise an adaptor securing the device to the first rod. The system further comprising fluid dispensing openings adjacent to the arc quenching zone, the fluid dispensing openings being in fluid connection with the plurality of side passages from the back surface of the device.

In a further embodiment of the present invention, a method for cooling a fluid in a circuit breaker is provided. The method comprises creating a flow of a fluid through a plurality of heat transferring side passages of a device for dissipating heat by moving the device toward and away a conductive rod through a fluid chamber of the circuit breaker, the plurality of heat transferring side passages having a heat transfer rate higher than a heat transfer rate of a central passage of the device.

The method further may comprise moving a rod of the circuit breaker toward or away from the gas chamber, the rod being sealingly inserted in the central passage of the device for dissipating heat. The method may further comprise displacing the device with the rod away from or toward the conductive rod when cooling the flowing hot fluid.

The features of the present invention which are believed to be novel are set forth with particularity in the appended claims.

BRIEF DESCRIPTION OF THE DRAWINGS

The above and other objects, features and advantages of the invention will become more readily apparent from the following description, reference being made to the accompanying drawings in which.

DETAILED DESCRIPTION OF THE PREFERRED EMBODIMENT

A novel system for controlling and cooling gas of circuit breaker will be described hereinafter. Although the invention is described in terms of specific illustrative embodiment(s), it is to be understood that the embodiment(s) described herein are by way of example only and that the scope of the invention is not intended to be limited thereby.

Figure 1:
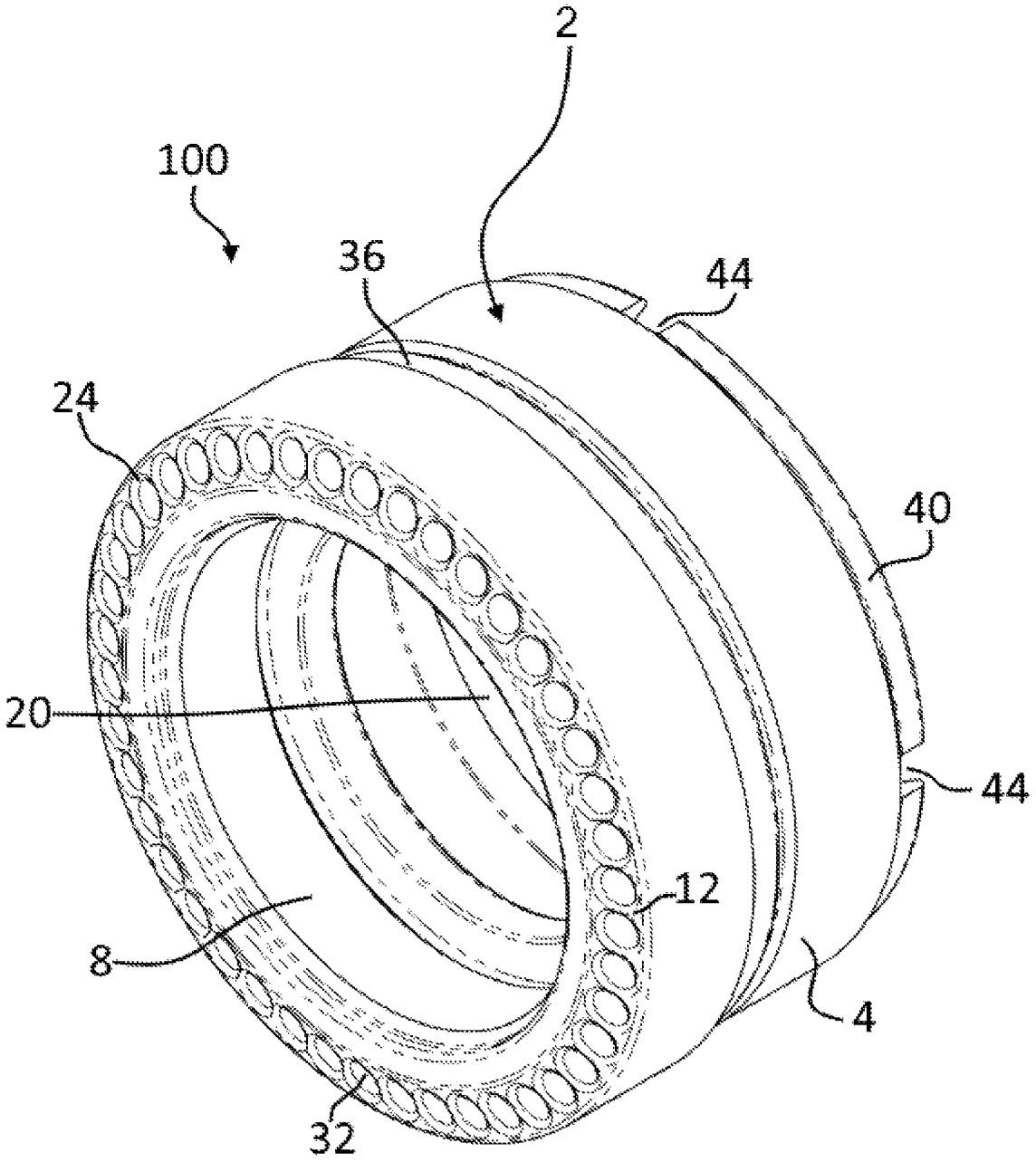
FIG. 1 is a front perspective view of a gas flow control and cooling system of a circuit breaker in accordance with the aspects of the invention.
Figure 4:
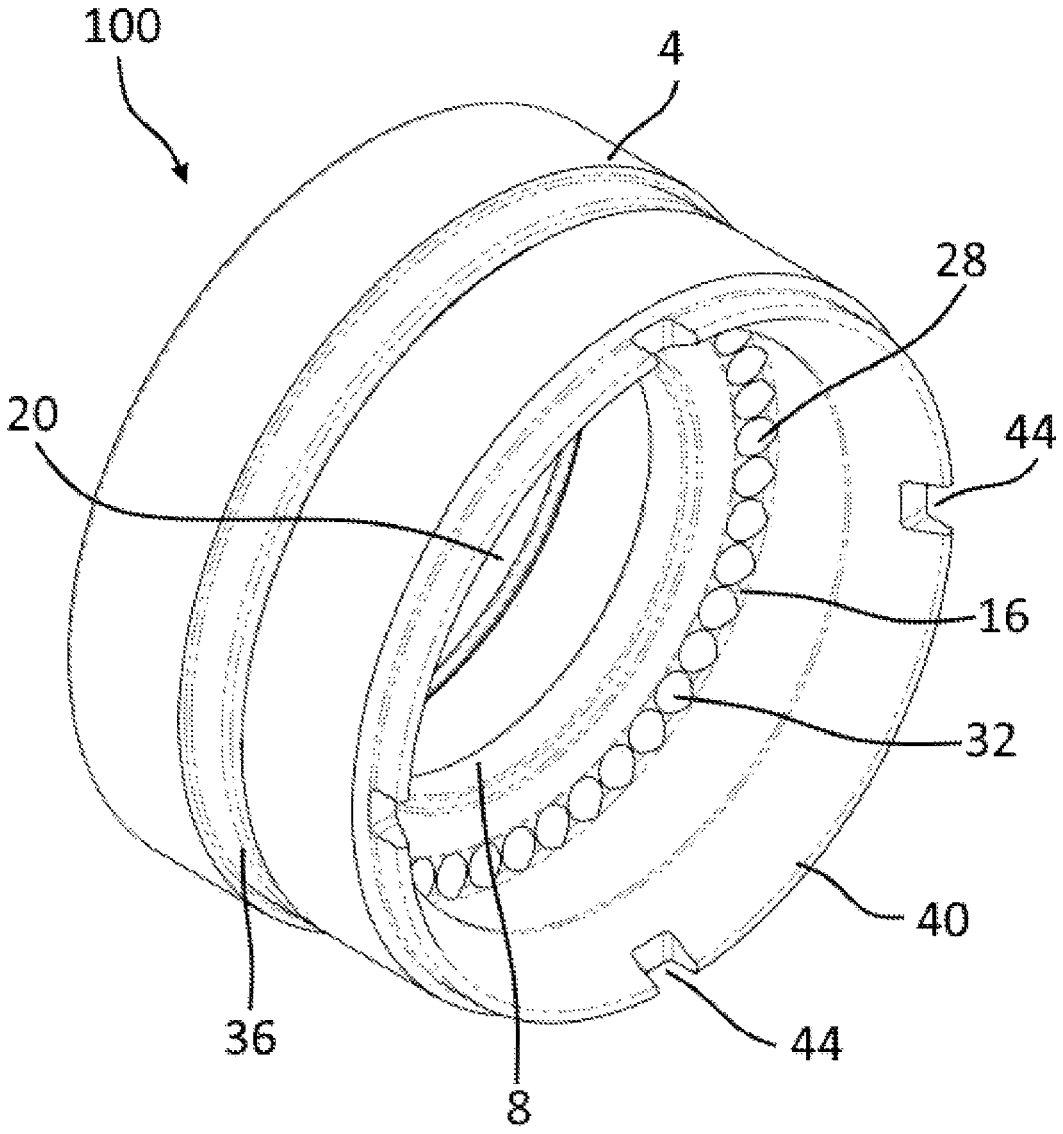
FIG. 4 is a rear perspective view of the system of FIG. 1.

Referring now to FIGS. 1 and 4, an embodiment of a system for controlling and cooling gas of a circuit breaker 100 is illustrated. Within the present disclosure, the system for controlling and cooling gas of a circuit breaker 100 is also referred to as a gas system or as a system.

In the illustrated embodiment, the system 100 comprises an outer portion 2 comprising an outer surface 4 and an inner surface 8. The system 100 further comprises an aperture 20 surrounded by the inner surface 8. In the illustrated embodiment, the system 100 has a general annular shape or is shaped as a generally cylindrical tube. Understandably, annular may be used to define any longitudinal shape having an aperture traversing its body. Furthermore, any other shape may be used respecting the hereinafter described aspects. For example, the system 100 of other embodiments may be in the form of a substantially rectangular elongated member having an aperture 20.

The system 100 further comprises a front surface 12 and a back surface 16 comprising the aperture 20. It is to be understood that the term surface is defined as a continuous set of points that has a length and breadth but no thickness or limited thickness. For example, in some embodiments, the surfaces may be flat whereas in others, the surfaces may be curved. The outer portion 2 comprises a plurality of passages 32. The passages 32 may thus substantially cover the perimeter or annular portion of the aperture 20. The front surface 12 comprises openings 24 in fluid communication with the passages 32. The back surface 16 comprises openings 28 in fluid communication with the passages 32. Understandably, the number of openings 24 or 28 is a function of the number of passages 32. In some embodiments, a plurality of openings (24, 28) on any or both of the surfaces (12, 16) may be fluidly connected to one passage 32 wherein in other embodiments, a plurality of passages 32 may be connected to one opening (24, 28) of a surface (12, 16). The openings 24, 28 are adapted to receive or expulse fluids, typically gas.

In some embodiments, the diameter of the openings 24, 28 of the front 12 and/or back 16 surfaces may nearly span the distance from the exterior surface 4 to the interior surface 8. In some embodiments, the openings 24, 28 may be positioned to cover the circumference or perimeter of the front 12 and/or back surfaces 16 of the system 100. In such embodiments, the distance between each of the adjacent openings (24, 28) is minimized. Each of the plurality of front surface openings 24 is fluidly connected to at least one of the plurality of back openings 28 to form a passage 32. It may be understood that a gas passing through a front opening 24 will be expelled through a corresponding back opening 28 and/or vice-versa. Understandably, the number, the dimensions and the shape of each opening 24, 28 and passages 32 may vary in other embodiments. For example, the openings 24, 28 may be shaped as, but are not limited to, a triangle, a square, a rectangle, a pentagon, a trapeze or trapezoid shape, etc.

Figure 2:
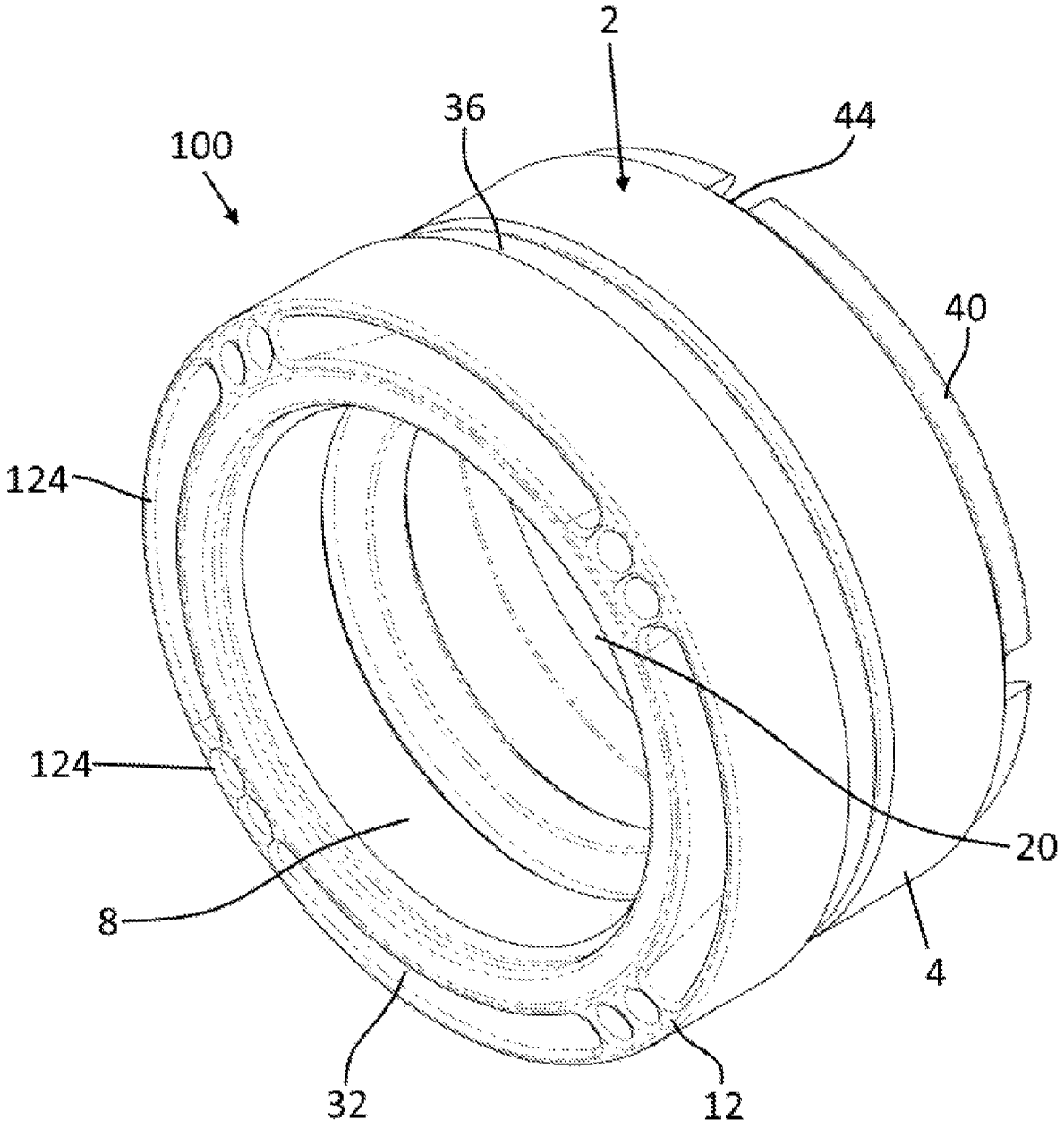
FIG. 2 is a front perspective view of another embodiment of a gas flow control and cooling system of a circuit breaker in accordance with the aspects of the invention.
Figure 3:
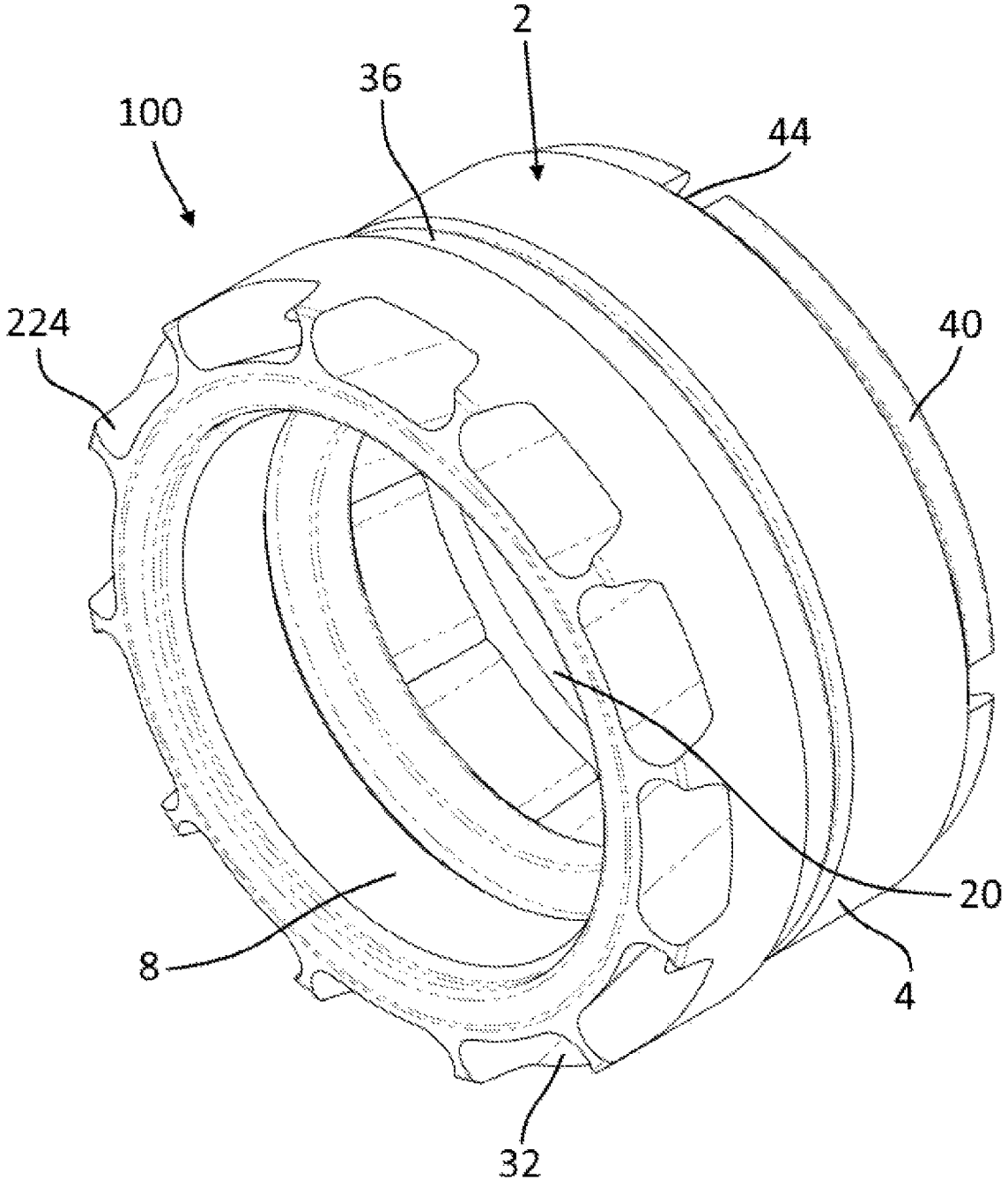
FIG. 3 is a front perspective view of yet another embodiment of a gas flow control and cooling system of a circuit breaker in accordance with the aspects of the invention.

Referring now to FIGS. 2 and 3, exemplary embodiments of openings are illustrated. FIG. 2 shows a front surface 12 comprising openings 124 having two distinct shapes. A first set of shapes are circles and a second set of shapes are longitudinal openings, such as elongated cylinders having rounded ends. In such embodiments, the first set of circular opening are alternatively positioned with one elongated opening. Understandably, any combinations of shaped thereof may be used within the scope of the present invention.

Referring now to FIG. 3, another exemplary embodiment of a front surface 12 comprising openings 224 having substantially rectangular shapes with rounded edges or trapezoid shapes is illustrated. In such embodiment, the openings allow an important flow of gas through the cooling device 100 while increasing the surface in contact with the flowing gas. As surface is increased, heat transfer is increased.

Referring back to FIGS. 1 and 4, one skilled in the art shall also understand that the front openings 24 may have different dimensions and/or shape than the associated back openings 28 and vice-versa. In further embodiments, a front opening 24 or back opening 28 may be connected to a plurality of corresponding back 28 and front 24 openings. The passage 32 associated with the openings 24, 28 has typically the same shape and dimensions as the corresponding openings 24, 28. By having a plurality of openings 24, 28 and passages 32 fluidly connecting said openings, gas passing through the passages 32 from an opening to the other 24, 28 may transfer heat (or cold) to or from any inner surface of the said passages 32. Accordingly, heat may be dissipated from gas flowing through the passages 32. It may be appreciated that heat may be dissipated at a fast and efficient rate due to the increased surface of convection of the plurality of passages 32. Thus, the total area of the inner surfaces is increased compared to a comparable surface of single aperture. The increased surface area increases heat transfer rate. Understandably, the heat transfer rate is generally dependent upon the area of heat transfer, thus to more the area of the inner surface of the passages 32, the more the heat transfer rate is increased. On the other end, the openings shall allow or maintain a non limiting fluid flow the passages 32. For example, the flow of fluid through the passages 32 may be optimized with the shape of the openings (24, 124, 224).

Still referring to FIGS. 1 and 4, the interior 4 and exterior 8 surfaces may further comprise notches or sleeve 36. The notches or sleeve 36 are generally adapted for fitting or fixing the system 100 within a circuit breaker or chamber of a circuit breaker.

In some embodiments, the rear surface 16 may comprise an extrusion, lip or protuberance 40. The extrusion 40 typically extends from the perimeter or circumference of the outer portion 2. The extrusion 40 may be adapted to guide and efficiently and/or hermetically connect the system 100 to the circuit breaker or to the chamber. The extrusion 40 may further comprise notches or recesses 44 to further increase guiding and stability of the installed system 100. Understandably, the design and/or configuration of the extrusion 40 may vary depending on the external system to which the system 100 is to be connected to. It may be understood that in other embodiments, though not shown, extrusions may also be found on the front surface if required for fitting with external systems.

Figure 5:
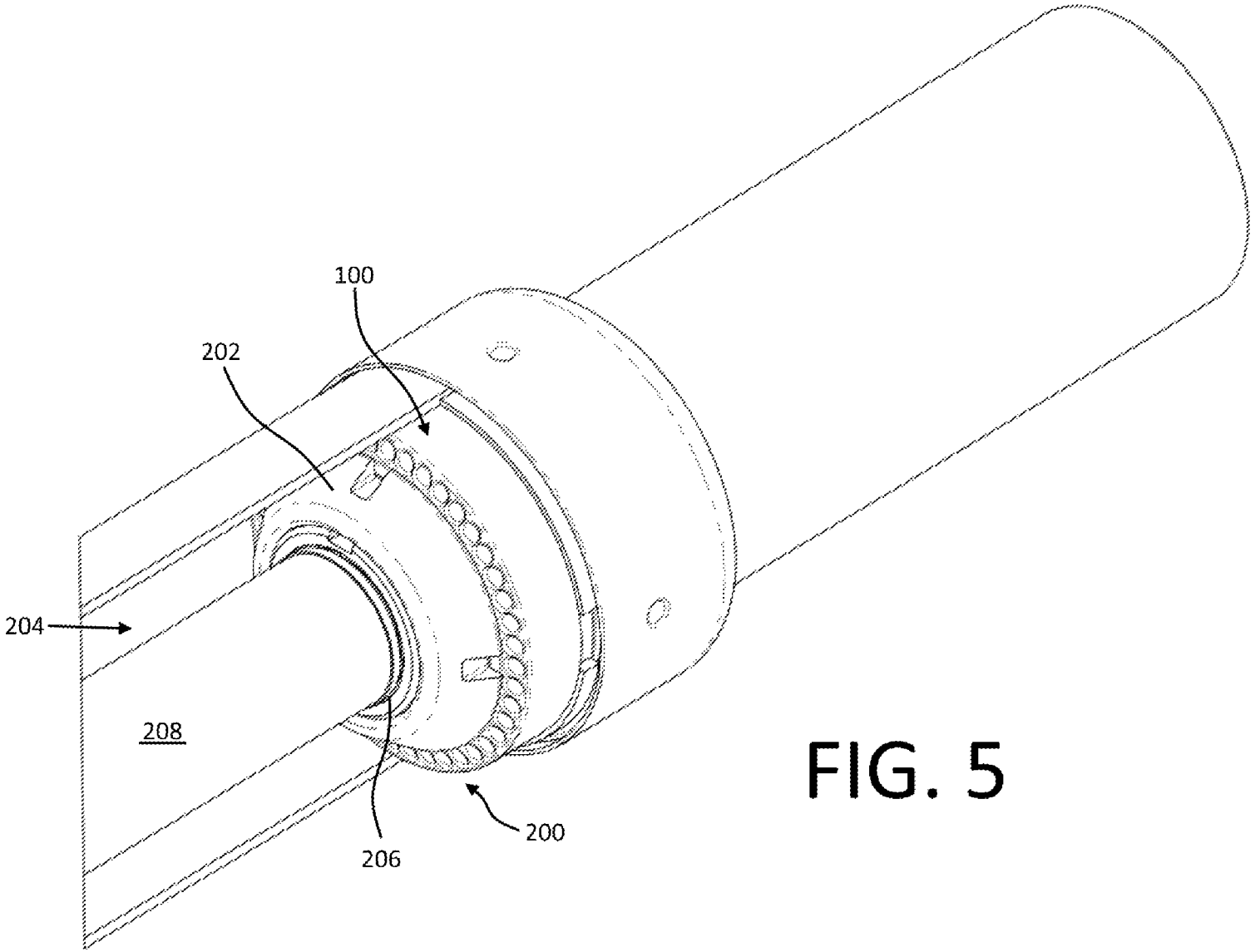
FIG. 5 is a perspective view of a circuit breaker assembly comprising a gas flow control and cooling system in accordance with the aspects of the invention.

Now referring to FIG. 5, the system 100 is illustrated as connected to a circuit breaker 200. The exemplary circuit breaker 200 comprises a rod 208, a gas chamber 204, an adaptor 202, a female contact 206, a housing 210 and a secondary gas chamber 203. In the present embodiment, the female contact 206 may be threaded. It may be understood that the system may be installed in any type of circuit breaker, such as a gas insulated circuit breaker, air insulated circuit breaker, etc. In the exemplary embodiment, the system 100 is installed in a circuit breaker 200 using gas. Understandably, the gas used may be SF6 or any other type of gas for the quenching of electrical arcs. The system 100 may be installed in an interrupting chamber 204 in which gas may flow. A displacement and/or conducting rod 208 may be connected to the interior surface 8 of the system 100 and may pass or be fitted through the inner passage 20 of the system 100.

Figure 6:
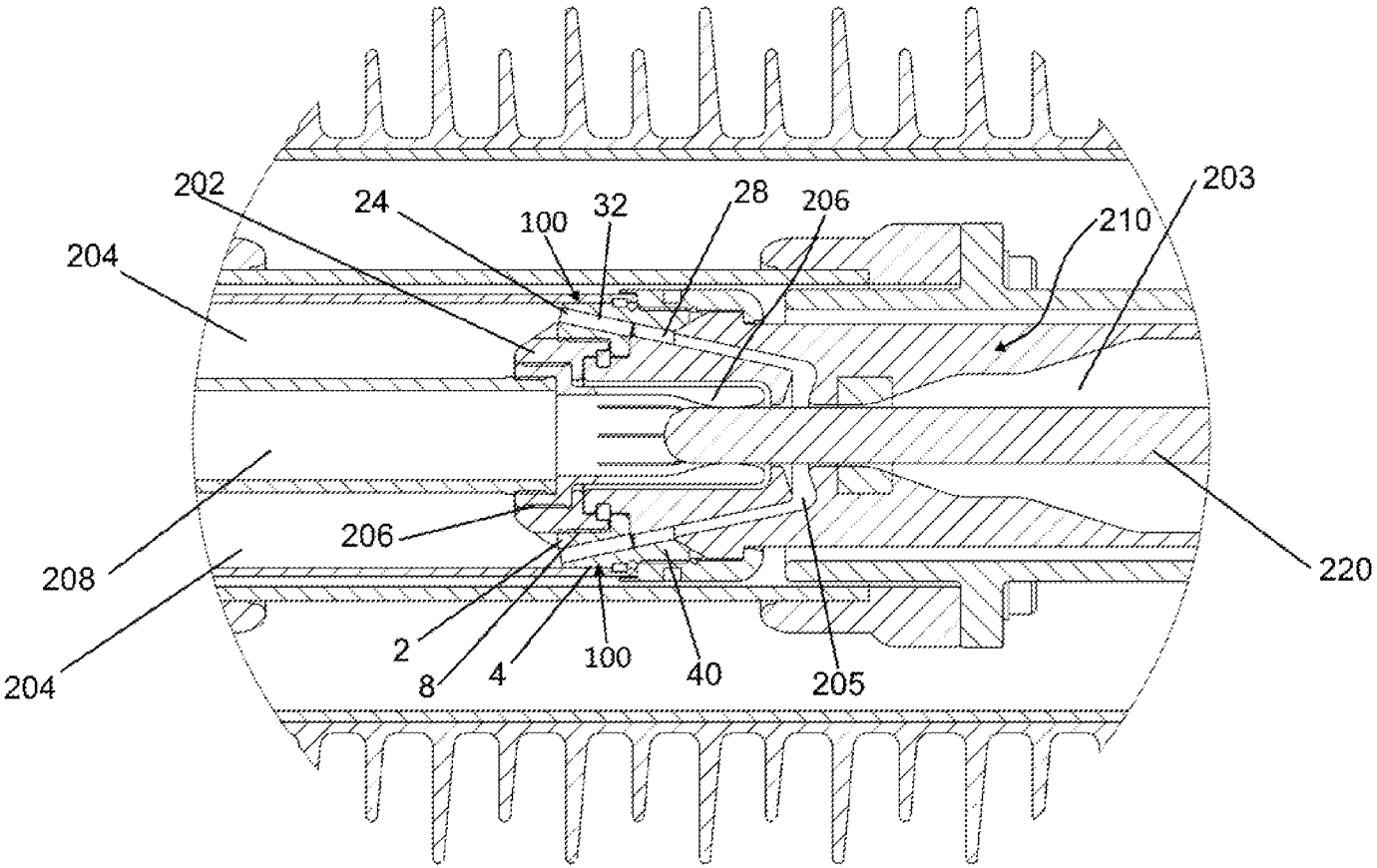
FIG. 6 is a side sectional view of a circuit breaker assembly comprising a gas flow control and cooling system in accordance with the aspects of the invention.

Now referring to FIG. 6, a sectional view of the system 100 installed in a circuit breaker 200 is shown. In such configuration, the rod 208 is fitted within the inner opening 20 of the system 100. As an example, the rod 208 may be a conducting and/or displacement rod in connection to a female contact 206. The openings 28 of the rear surface 16 are in fluid communication with the live portion of the circuit while the openings 24 of the front surface 12 are in fluid communication with the gas chamber 204. Understandably, the openings 28 of the back surface of the system 100 may be aligned and/or positioned to receive fluid from the circuit breaker 200. Accordingly, the openings 28 may be aligned with other fluid dispensing openings 205 of the circuit breaker 200 or any volume of the circuit breaker 200 containing fluid to be dispensed.

In operation, the circuit breaker 200 is opened and closed when it receives a command from an external operator, not shown. The command may be given when a situation of short circuit is detected in the circuit breaker 200 or the system comprising said circuit-breaker. The female contact 206 is attached to the rod 208 which is in turn connected to the external operator. It may be understood, that when the rod 208 and female contact 206 are displaced, the adaptor 202, the system 100 and the gas chamber 204 are similarly displaced as they are attached to the rod 208 and female contact 206. The elements 202, 204, 206, 208, 210 and 100 are connected to the external operator. The said elements 202, 204, 206, 208, 210 and 100 are moved away from the chamber 203, the circuit is opened. When the circuit is opened, the contact 206 and the conductive rod 220 are detached one from another. Electrical arcs are typically formed in the area between the contact 206 and the conductive rod 220. The gas within the area between the contact 206 and the conductive rod 220 is replaced by denser gas to improve or accelerate the quenching of the formed electrical arcs.

As the elements 202, 204, 206, 208, 210 and 100 move toward the left, the volume of gas present in the said gas chamber 204 is reduced. The resulting compression of the gas increases the pressure of the gas within the said gas chamber 204. As the pressure is increased in the chamber 204, the gas within the said chamber 204 is naturally moved to a zone having a lower pressure. In the present embodiment, the gas moves from the gas chamber 204 to the area between the female contact 206 and the conducting rod 220 through the passages 32 of the system 100. As the gas fills the passage, the gas is cooled by the material forming the passages 32. In the illustrated embodiment, each passage 32 has an inner surface allowing dissipation of heat by convection. The plurality of passages 32 greatly increases the surface allowing heat transfer. The number of passages multiplies the total area of convection compared to other systems having a single passage circling the entire cylinder. Understandably, the gas may flow in the passages 32 in any direction, such as toward the gas chamber 204 or toward the area between the female contact 206 and the conducting rod 220.

The system 100 may be made of any material known in the art for the manufacture of circuit breaker parts. The system 100 is generally made of material having heat transfer properties or heat dissipation properties. The system 100 may further be made of material adapted to withstand high electrical currents and high temperatures of operation without significant deformation. For example, the system may be made of metallic materials, such as aluminum, copper, etc.

While illustrative and presently preferred embodiment(s) of the invention have been described in detail hereinabove, it is to be understood that the inventive concepts may be otherwise variously embodied and employed and that the appended claims are intended to be construed to include such variations except insofar as limited by the prior art.

The invention claimed is:

1. A fluid cooling device for a circuit breaker, the device having an annular main body comprising:

a front surface;

a back surface;

an outer portion comprising outer and inner surfaces;

a central passage connecting an aperture of the front surface to an aperture of the back surface, the central passage being adapted to receive a rod of the circuit breaker; and a plurality of side passages through the outer portion connecting the front surface to the back surface, the plurality of side passages comprising an inner passage surface allowing flow of the fluid through the outer portion of the annular main body, the plurality of side passages having a heat transfer rate being higher than a heat transfer rate of the central passage.

2. The device of claim 1, the front surface comprising a plurality of front openings, each of the plurality of front openings being fluidly connected to one of the plurality of the side passages and the back surface comprising a plurality of back openings, each of the plurality of back openings being fluidly connected to one of the plurality of the side passages.

3. The device of claim 2, each of the plurality of the front openings being associated with one of the plurality of back openings.

4. The device of claim 2, each of the plurality of side passages being fluidly connected to more than one of the plurality of front openings.

5. The device of claim 4, each of the plurality of side passages being fluidly connected to more than one of the plurality of back openings.

6. The device of claim 2, the plurality of side passages and of front and back openings having a rectangular shape.

7. The device of claim 1, further comprising a connecting member extending from the back surface for connecting the device to the circuit breaker.

8. The device of claim 7, the connecting member being a protuberance.

9. The device of claim 8, the connecting member having a periphery larger than a periphery of the central passage.

10. The device of claim 8, the connecting member being an annular portion extending from the outer portion of the device.

11. The device of claim 7, a peripheral section of the connecting member comprising notches adapted to mate with a portion of the circuit breaker.

12. The device of claim 1, the outer surface comprising notches adapted to mate with the circuit breaker.

13. The device of claim 1, the outer surface comprising sleeves to mate with the circuit breaker.

14. The device of claim 1, the main body having a circular annular shape.

15. The device of claim 14, the main body being shaped as a generally cylindrical tube.

16. The device of claim 1, the main body having a non-circular annular shape.

17. The device of claim 1, the fluid being gas.

18. The device of claim 1, the plurality of side passages having a rectangular shape.

19. The device of claim 1, some sectional area of a first of the side passages having a different shape than the sectional area of a second of the side passages.

20. A circuit breaker system, the system comprising:

a device having an annular main body comprising a front surface, a back surface, an outer portion comprising outer and inner surfaces, a central passage passing through the front surface and the back surfaces and a plurality of side passages through the outer portion connecting the front surface to the back surface, the plurality of side passages comprising an inner passage surface allowing flow of the fluid through the outer portion of the annular main body, the plurality of side passages having a superior heat transfer rate than a heat transfer rate of the central passage;

a first rod fitting inside the central passage and being adapted to be secured to a contact;

a second rod adapted to contact with the contact and to move away from the contact;

a fluid chamber in fluid connection with the plurality of side passages from the front surface of the device; and an arc quenching zone between the contact and the second rod, the arc quenching zone being in fluid connection with the plurality of side passages from the back surface of the device;

wherein displacement of the contact toward and away from the second rod creates flow of the fluid in the side passages of the device.

21. The circuit breaker system of claim 20, the system further comprising an adaptor securing the device to the first rod.

22. The circuit breaker system of claim 20, the system further comprising fluid dispensing openings adjacent to the arc quenching zone, the fluid dispensing openings being in fluid connection with the plurality of side passages from the back surface of the device.

23. A method for cooling a fluid in a circuit breaker, the method comprising creating a flow of a fluid through a plurality of heat transferring side passages of a device for dissipating heat by moving the device toward and away a conductive rod through a fluid chamber of the circuit breaker, the plurality of heat transferring side passages having a heat transfer rate higher than a heat transfer rate of a central passage of the device.

24. The method of claim 23, the method further comprising moving a rod of the circuit breaker toward or away from the gas chamber, the rod being sealingly inserted in the central passage of the device for dissipating heat.

25. The method of claim 24, the method further comprising displacing the device with the rod away from or toward the conductive rod when cooling the flowing hot fluid.

* * * * *